US009472148B2

(12) United States Patent
Cho et al.

(10) Patent No.: US 9,472,148 B2
(45) Date of Patent: Oct. 18, 2016

(54) LIQUID CRYSTAL DISPLAY DEVICE HAVING GATE SHARING STRUCTURE AND METHOD OF DRIVING THE SAME

(71) Applicant: LG DISPLAY CO., LTD., Seoul (KR)

(72) Inventors: Su-Hong Cho, Gumi-si (KR); Sang-Bum Ko, Gumi-si (KR); Jun-Yeob Lee, Daegu (KR); Soo-Ho Kim, Gyeongsangbuk-do (KR); Moon-Chul Kim, Chungcheongnam-do (KR); Sung-Woo Lee, Gyeongsangbuk-do (KR); Hyun-Jik Bae, Daegu (KR)

(73) Assignee: LG DISPLAY CO., LTD, Seoul (KR)

( * ) Notice: Subject to any disclaimer, the term of this patent is extended or adjusted under 35 U.S.C. 154(b) by 0 days.

(21) Appl. No.: 14/143,138

(22) Filed: Dec. 30, 2013

(65) Prior Publication Data

US 2014/0210868 A1 Jul. 31, 2014

(30) Foreign Application Priority Data

Jan. 25, 2013 (KR) ..... 10-2013-0008571

(51) Int. Cl.
*G09G 3/36* (2006.01)

(52) U.S. Cl.
CPC .... *G09G 3/3648* (2013.01); *G09G 2300/0443* (2013.01); *G09G 2300/0465* (2013.01); *G09G 2300/0495* (2013.01); *G09G 2310/021* (2013.01)

(58) Field of Classification Search
CPC ..... G09G 3/2022–3/204; G09G 3/3266; G09G 3/3659; G09G 3/3674–3/3681; G09G 2310/02–2310/0205; G09G 2310/021–2310/0216; G09G 2310/0262–2310/0267; G09G 2310/0278–2310/0283; G09G 2300/0439–2300/0452
See application file for complete search history.

(56) References Cited

U.S. PATENT DOCUMENTS

| | | | | |
|---|---|---|---|---|
| 2004/0246404 | A1* | 12/2004 | Elliott et al. | 349/88 |
| 2006/0001638 | A1 | 1/2006 | Jeon et al. | |
| 2006/0187368 | A1 | 8/2006 | Kim et al. | |
| 2006/0208981 | A1* | 9/2006 | Rho et al. | 345/88 |
| 2011/0164076 | A1* | 7/2011 | Lee | 345/691 |

FOREIGN PATENT DOCUMENTS

| | | | |
|---|---|---|---|
| CN | 1744184 | A | 3/2006 |
| CN | 1799080 | A | 7/2006 |
| CN | 1825172 | A | 8/2006 |
| CN | 1864198 | A | 11/2006 |
| WO | WO 2004/021323 | A2 | 3/2004 |

* cited by examiner

*Primary Examiner* — Sanghyuk Park
(74) *Attorney, Agent, or Firm* — Birch, Stewart, Kolasch & Birch, LLP

(57) ABSTRACT

The present invention provides a liquid crystal display device including gate lines extending on a substrate; data lines crossing the gate lines to define a plurality of pixels; a thin film transistor in each pixel; and a liquid crystal capacitor in each pixel region, an electrode of the liquid crystal capacitor is connected to the thin film transistor, wherein the thin film transistors of a (2a−1)th pixel and a (2a)th pixel in a (2b)th pixel column share a (2a)th gate line, and the thin film transistors in a (2a)th pixel and a (2a+1)th pixel in a (2b+1)th pixel column share a (2b+1)th gate line, and wherein each of a and b is a positive integer.

9 Claims, 3 Drawing Sheets

LIQUID CRYSTAL DISPLAY DEVICE HAVING GATE SHARING STRUCTURE AND METHOD OF DRIVING THE SAME

The present application claims the benefit of Korean Patent Application No. 10-2013-0008571 filed in Korea on Jan. 25, 2013, which is hereby incorporated by reference for all purposes as if fully set forth herein.

BACKGROUND OF THE INVENTION

1. Field of the Invention

The present invention relates to a liquid crystal display (LCD) device, and more particularly, to an LCD device having less power consumption and a gate sharing structure and a method of driving the same.

2. Discussion of the Related Art

The LCD device as a display device is driven by using optical anisotropy and polarization properties of liquid crystal molecules. The LCD device is widely used for a display part of mobile electronic equipments, a monitor of computers and televisions.

The liquid crystal molecules have a definite alignment direction as a result of their thin and long shapes. The alignment direction of the liquid crystal molecules can be controlled by application of an electric field across the liquid crystal molecules. As the intensity or direction of the electric field is changed, the alignment of the liquid crystal molecules also changes.

The LCD device includes two substrates respectively including an electric field generating electrode and a liquid crystal layer therebetween. The alignment of the liquid crystal molecules are changed by an electric field between the electrodes such that images can be displayed by controlling light transmissivity.

The LCD device includes an array substrate, a color filter substrate and a liquid crystal layer interposed therebetween. The array substrate may include a pixel electrode and TFT, and the color filter substrate may include a color filter layer and a common electrode. The LCD device is driven by an electric field between the pixel electrode and the common electrode resulting in excellent properties of transmittance and aperture ratio. However, since this LCD device uses a vertical electric field, the LCD device has a bad viewing angle.

An in-plane switching (IPS) mode LCD device may be used to resolve the above-mentioned limitations. The related art IPS mode LCD device includes a color filter substrate, an array substrate facing the color filter substrate, and a liquid crystal layer interposed therebetween. Both common and pixel electrodes for driving the liquid crystal layer are formed on the array substrate such that a horizontal electric field is induced between the pixel and common electrodes. Since the liquid crystal molecules are driven by the horizontal electric field, the IPS mode LCD device has improved viewing angle. However, the IPS mode LCD device has disadvantages in the aperture ratio and the transmittance.

To overcome the disadvantages of the IPS mode LCD device, a fringe field switching (FFS) mode LCD device is introduced. Hereinafter, the related art FFS mode LCD device is explained.

FIG. 1 is a schematic view of the related art FFS mode LCD device, and FIG. 2 is a circuit diagram of pixels in the related art FFS mode LCD device.

Referring to FIGS. 1 and 2, in the related art FFS mode LCD device, a plurality of data lines DL1 to DL10 and a plurality of gate lines GL1 to GL4 are formed to cross each other. A plurality of pixels R11 to R43, G11 to G43 and B11 to B43 are defined by the plurality of data lines DL1 to DL10 and the plurality of gate lines GL1 to GL4.

Each of the plurality of pixels R11 to R43, G11 to G43 and B11 to B43 includes a thin film transistor (TFT) Tr, a storage capacitor Cst and a liquid crystal capacitor CLC. The liquid crystal capacitor CLC includes a pixel electrode (not shown) and a common electrode Vcom. The pixel electrode is electrically connected to the TFT.

The plurality of pixels R11 to R43, G11 to G43 and B11 to B43 are arranged in a stripe shape.

For example, the pixels arranged along a vertical direction include the same color filter, e.g., red color filter, and different color filters, e.g., red, green and blue color filters, are alternately arranged in the pixels along a horizontal direction.

In this pixel structure, the TFT in one pixel of vertically adjacent two pixels is electrically connected to the gate line between the vertically adjacent two pixels. Accordingly, an area for the TFT is required in each of the pixels R11 to R43, G11 to G43 and B11 to B43. As a result, the aperture ratio and the transmittance of the pixels are decreased by the region for the TFT.

Namely, although the FFS mode LCD device has been developed to overcome the disadvantages, e.g., the aperture ratio and the transmittance, of the IPS mode LCD device, there still are disadvantages in the aperture ratio and the transmittance.

SUMMARY OF THE INVENTION

Accordingly, the present invention is directed to an LCD device and a method of driving the same that substantially obviate one or more of the problems due to limitations and disadvantages of the related art.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described herein, the present invention provides a liquid crystal display device including gate lines extending on a substrate; data lines crossing the gate lines to define a plurality of pixels; a thin film transistor in each pixel; and a liquid crystal capacitor in each pixel region, an electrode of the liquid crystal capacitor is connected to the thin film transistor, wherein the thin film transistors of a $(2a-1)$th pixel and a $(2a)$th pixel in a $(2b)$th pixel column share a $(2a)$th gate line, and the thin film transistors in a $(2a)$th pixel and a $(2a+1)$th pixel in a $(2b+1)$th pixel column share a $(2b+1)$th gate line, and wherein each of a and b is a positive integer.

In another aspect of the present invention, the present invention provides a method of driving a liquid crystal display device, which includes first to fourth gate lines, first to seventh data lines crossing the first to fourth gate lines to define 18 pixels arranged in a 3*6 matrix; a thin film transistor in each pixel; first to third color filters corresponding to each pixel; and a liquid crystal capacitor in each pixel region, an electrode of the liquid crystal capacitor is connected to the thin film transistor, wherein the thin film transistors of a $(2a-1)$th pixel and a $(2a)$th pixel in a $(2b)$th pixel column share a $(2a)$th gate line, and the thin film transistors in a (2*a*)th pixel and a (2*a*+1)th pixel in a (2*b*+1)th pixel column share a (2*b*+1)th gate line, wherein the thin film transistors of a (2*c*−1)th pixel and a (2*c*)th pixel in a (2*d*−1)th pixel row share a (2*c*)th data line, and the thin film transistors of a (2*c*)th pixel and a (2*c*+1)th pixel in a (2*d*)th pixel row share a (2*c*+1)th data line, wherein one of the first to third color filters are arranged in a zigzag shape in two adjacent pixel columns, and the first to third color filters are alternately arranged in each pixel row, and wherein each of a, b, c and d is a positive integer, the method comprising: applying a first gate signal into the second gate line; applying a high-gray data signal into the third and fourth data lines and a low-gray data signal into the first, second and fifth to seventh data lines; applying a second gate signal into the third gate line; and applying a high-gray data signal into the second and fifth data lines and a low-gray data signal into the first, third, fourth, sixth and seventh data lines.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to the preferred embodiments, examples of which are illustrated in the accompanying drawings.

Figure 3:
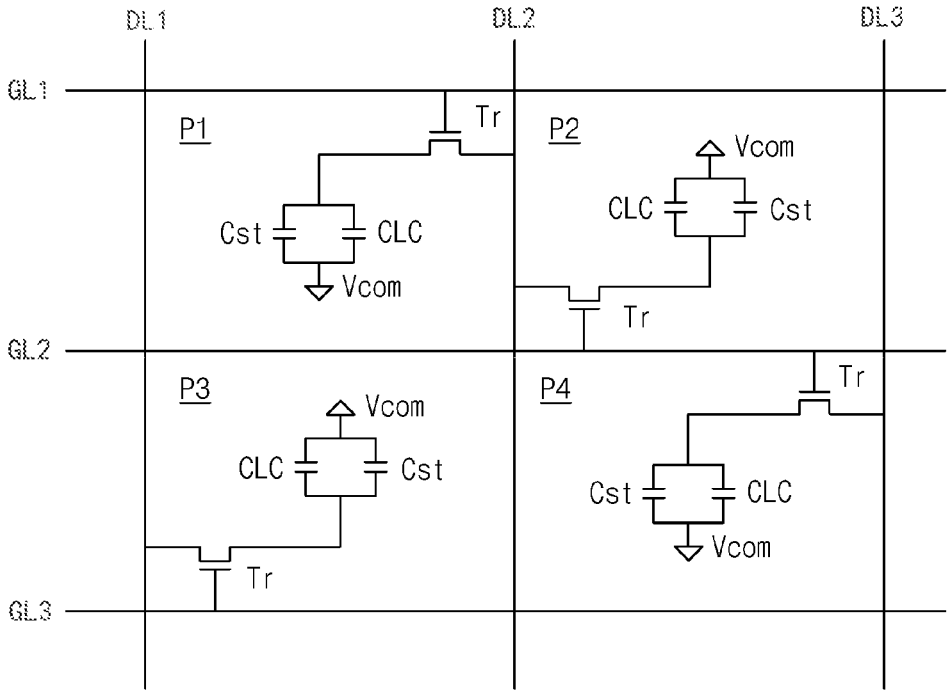
FIG. 3 is a circuit diagram of pixels in an LCD device according to the present invention.

FIG. 3 is a circuit diagram of pixels in an LCD device according to the present invention.

Referring to FIG. 3, in the LCD device of the present invention, first to third gate lines GL1, GL2 and GL3 and first to third data lines DL1, DL2 and DL3 are formed on a substrate (not shown). The gate lines GL1 to GL3 and the data lines DL1 to DL3 cross each other to define first to fourth pixels P1, P2, P3 and P4. The first to fourth pixels P1 to P4 are arranged in a 2*2 matrix shape.

Each of the first to fourth pixels P1 to P4 includes a thin film transistor (TFT) Tr, a storage capacitor Cst and a liquid crystal capacitor CLC. The liquid crystal capacitor CLC includes a pixel electrode (not shown) and a common electrode Vcom. The pixel electrode is electrically connected to the TFT.

In addition, the LCD device includes first to third color filters, e.g., red, green and blue color filters. The first to third color filters correspond to each pixel.

In this instance, two adjacent pixels along a direction of the data line DL1 to DL3 share one of the gate line GL1 to GL3. In FIG. 3, the second and fourth pixels P2 and P4 share the second gate line GL2. Namely, the LCD device has a gate-sharing configuration.

In addition, two adjacent pixels along a direction of the gate line GL1 to GL3 share one of the data line DL1 to DL3. In FIG. 3, the first and second pixels P1 and P2 share the second data line DL2.

Figure 4:
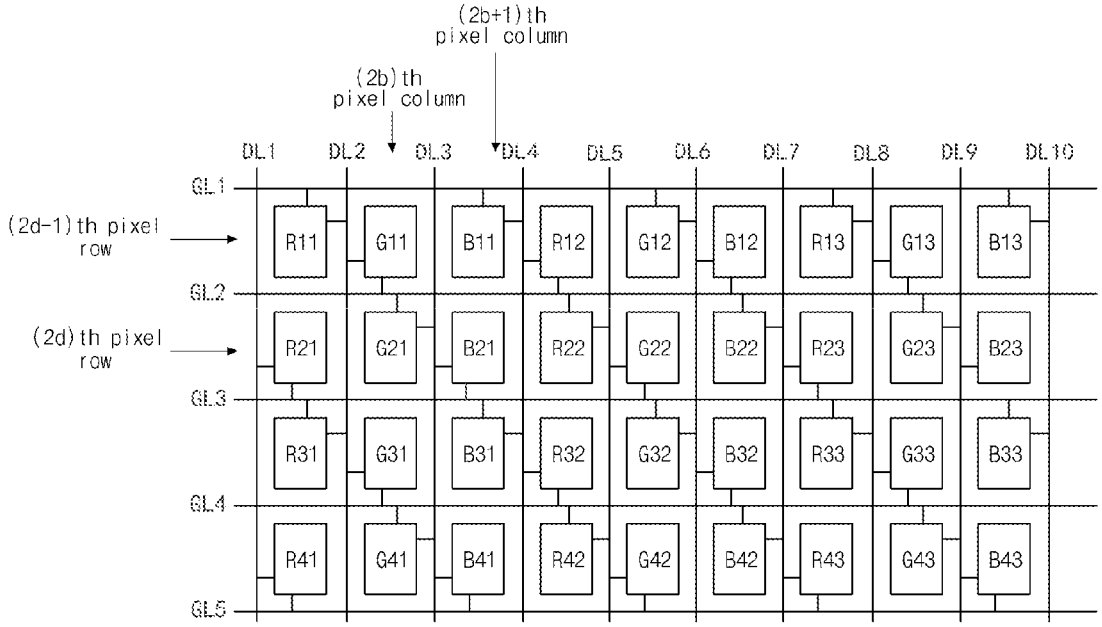
FIG. 4 is a schematic plan view of a pixel arrangement in an LCD device according to a first embodiment of the present invention.

FIG. 4 is a schematic plan view of a pixel arrangement in an LCD device according to a first embodiment of the present invention.

Referring to FIG. 4, in the LCD device according to the first embodiment of the present invention, first to tenth data lines DL1 to DL10 and first to fifth gate lines GL1 to GL5 are formed on the substrate (not shown). The first to tenth data lines DL1 to DL10 and the first to fifth gate lines GL1 to GL5 cross each other to define 36 pixels. However, the numbers of the gate lines, the data lines and the pixels are not limited thereto.

In addition, the LCD device includes first to third color filters, i.e., red, green and blue color filters. The red, green and blue color filters correspond to each pixel such that red pixels R11 to R13, R21 to R23 and R31 to R33, green pixels G11 to G13, G21 to G23 and G31 to G33, and blue pixels B11 to B13, B21 to B23 and B31 to B33 are defined.

In a pixel row along a direction of the gate line, the red pixel, the green pixel and the blue pixel are alternately arranged. In a pixel column along a direction of the data line, one of the red, green and blue pixels are continuously arranged. In other words, the pixels are arranged in a stripe shaped.

In the LCD device, adjacent pixels share the gate line, and adjacent pixels share the data line. As a result, an area for the TFT is reduced in comparison to the related art LCD device such that the aperture ratio and the transmittance in the pixel are improved.

In more detail, the TFTs Tr (of FIG. 3) of a (2*a*−1)th pixel and a (2*a*)th pixel in a (2*b*)th pixel column share a (2*a*)th gate line, and the TFTs Tr (of FIG. 3) in a (2*a*)th pixel and a (2*a*+1)th pixel in a (2*b*+1)th pixel column share a (2*b*+1)th gate line. (Each of "a" and "b" is a positive integer.) In FIG. 4, the TFT Tr of the green pixel G11, e.g., the first pixel in the second pixel column, and the TFT Tr of the green pixel G21, e.g., the second pixel in the second pixel column, share the second gate line GL2. In addition, the TFT Tr of the blue pixel B21, e.g., the second pixel in the third pixel column, and the TFT Tr of the blue pixel B31, e.g., the third pixel in the third pixel column, share the third gate line GL3.

On the other hand, the thin film transistors Tr of a (2*c*−1)th pixel and a (2*c*)th pixel in a (2*d*−1)th pixel row share a (2*c*)th data line, and the thin film transistors of a (2*c*)th pixel and a (2*c*+1)th pixel in a (2*d*)th pixel row share a (2*c*+1)th data line. (Each of "c" and "d" is a positive integer.) In FIG. 4, the TFT Tr of the red pixel R11, e.g., the first pixel in the first pixel row, and the TFT Tr of the green pixel G11, e.g., the second pixel in the first pixel row, share the second data line DL2. In addition, the TFT Tr of the green pixel G21, e.g., the second pixel in the second pixel row, and the TFT Tr of the blue pixel B21, e.g., the third pixel in the second pixel row, share the third data line DL3.

For example, the TFT Tr of the red pixel R11 in the first pixel column and the first pixel row is electrically connected to the first gate line GL1 and the second data line DL2, and the TFT Tr of the red pixel R21 in the first pixel column and the second pixel row is electrically connected to the third gate line GL3 and the first data line DLL The TFT Tr of the green pixel G11 in the second pixel column and the first pixel row is electrically connected to the second gate line GL2 and the second data line DL2, and the TFT Tr of the green pixel G21 in the second pixel column and the second pixel row is electrically connected to the second gate line GL2 and the third data line DL3. The TFT Tr of the blue pixel B11 in the third pixel column and the first pixel row is electrically connected to the first gate line GL1 and the fourth data line DL4, and the TFT Tr of the blue pixel B21 in the third pixel column and the second pixel row is electrically connected to the third gate line GL3 and the third data line DL3.

When the full white image (full color image) is displayed with the above LCD device, the power consumption is substantially equal to the related art LCD device.

However, when one color image, e.g., a red image, is displayed, the power consumption of the above LCD device is increased.

Figure 1:
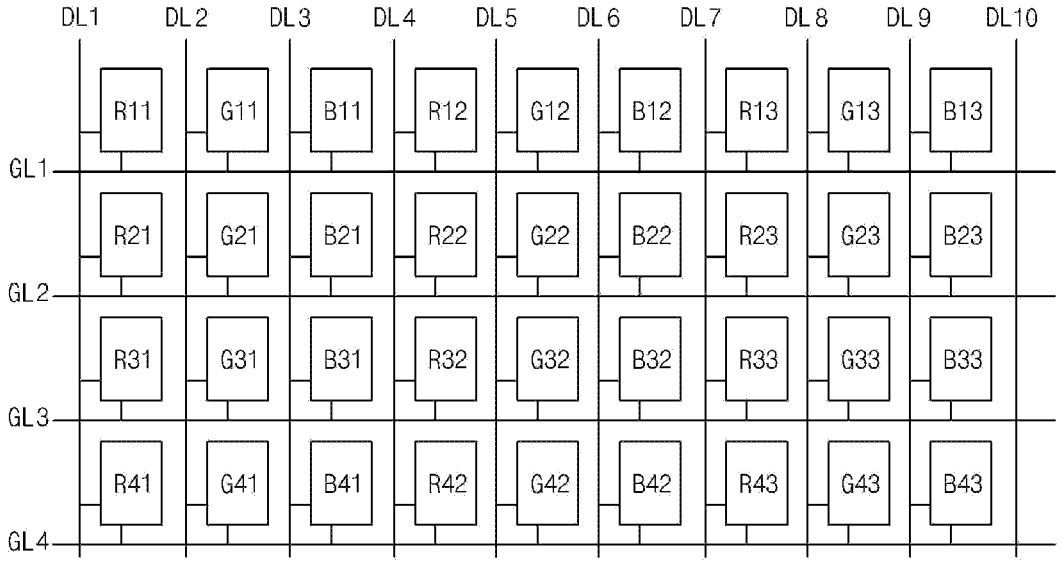
FIG. 1 RELATED ART
FIG. 1 is a schematic view of the related art FFS mode LCD device.
Figure 2:
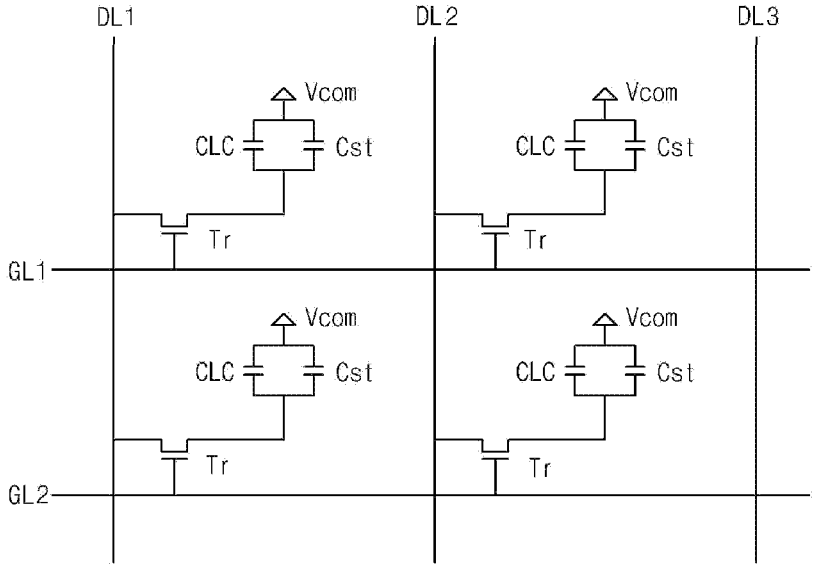
FIG. 2 RELATED ART
FIG. 2 is a circuit diagram of pixels in the related art FFS mode LCD device.

For example, in the related art LCD device having the pixel arrangement in FIG. 1, a high-gray data signal is applied into the first, fourth and seventh data lines DL1, DL4 and DL7 for every gate lines GL1 to GL4 to display the red image.

However, in the LCD device having the pixel arrangement in FIG. 3, the number of the data lines, where the high-gray data signal should be applied, is changed with respect to the gate lines.

Namely, when the gate signal is applied to the second gate line GL2, the high-gray data signal is applied into two data lines, i.e., the fourth and fifth data lines DL4 and DL5, to drive two red pixels R12 and R22. In this instance, the low-gray data signal is applied into other data lines, i.e., the first to third and sixth to tenth data lines DL1 to DL3 and DL6 to DL10. On the other hand, when the gate signal is applied to the third gate line GL3, the high-gray data signal is applied into four data lines, i.e., the first, second, seventh and eighth data lines DL1, DL2, DL7 and DL8, to drive four red pixels R21, R23, R31 and R33. In this instance, the low-gray data signal is applied into other data lines, i.e., the third to sixth, ninth and tenth data lines DL3 to DL6, DL9 and DL10.

As explained above, the high-gray data signal is applied to two data lines when the second gate line GL2 is selected, while the high-gray data signal is applied to four data lines when the third gate line GL3 is selected. Namely, in the LCD device in FIG. 3, with respect to the gate lines, the number of the data lines, where the high-gray data signal is applied, is changed.

Accordingly, the power consumption for an amplifier (not shown) amplifying the output signal of the data driving circuit (not shown) is increased.

Consequently, the aperture ratio and the transmittance of the LCD device in FIG. 3 are improved in comparison to the related art LCD device by sharing the gate line and the data line. However, the number of the data lines, where the high-gray data signal should be applied, is changed with respect to the selected gate line, there is a disadvantage in the power consumption.

Figure 5:
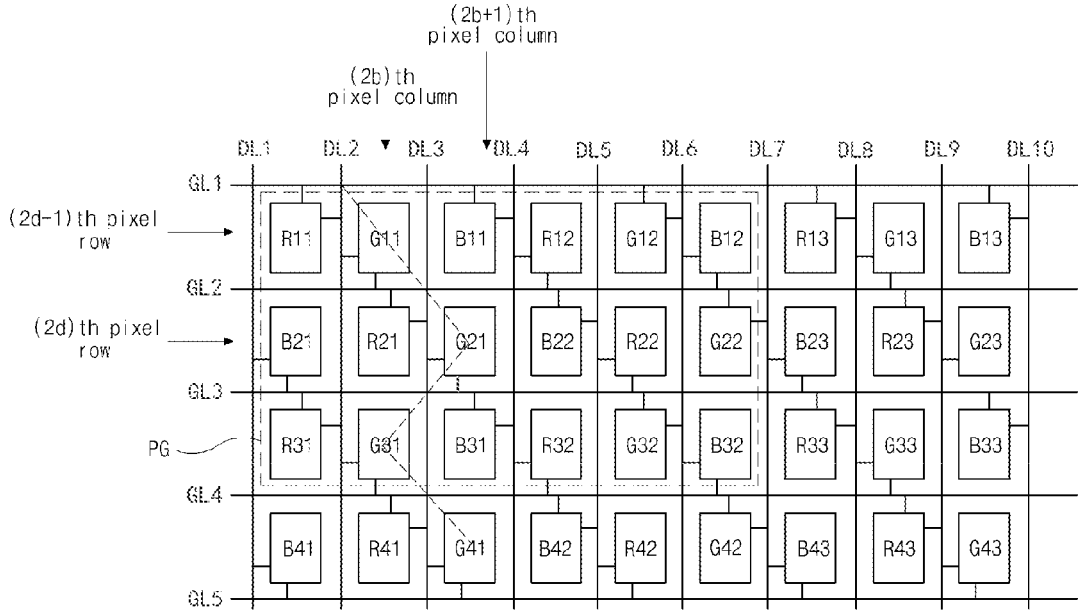
FIG. 5 is a schematic plan view of a pixel arrangement in an LCD device according to a second embodiment of the present invention.

FIG. 5 is a schematic plan view of a pixel arrangement in an LCD device according to a second embodiment of the present invention. The above problem can be overcome in the LCD device having the pixel arrangement in FIG. 5.

Referring to FIG. 5, in the LCD device according to the second embodiment of the present invention, first to tenth data lines DL1 to DL10 and first to fifth gate lines GL1 to GL5 are formed on the substrate (not shown). The first to tenth data lines DL1 to DL10 and the first to fifth gate lines GL1 to GL5 cross each other to define 36 pixels. However, the numbers of the gate lines, the data lines and the pixels are not limited thereto.

In addition, the LCD device includes first to third color filters, i.e., red, green and blue color filters. The red, green and blue color filters correspond to each pixel such that red pixels R11 to R13, R21 to R23 and R31 to R33, green pixels G11 to G13, G21 to G23 and G31 to G33, and blue pixels B11 to B13, B21 to B23 and B31 to B33 are defined.

In a pixel row along a direction of the gate line, the red pixel, the green pixel and the blue pixel are alternately arranged. In a pixel column along a direction of the data line, two different pixels are alternately arranged. For example, in a first pixel column, the red pixels R11 and R31 are arranged in a first pixel row and a third pixel row, and the blue pixels B21 and B41 are arranged in a second pixel row and a fourth pixel row. Namely, the red pixels R11 and R31 and the blue pixels B21 and B41 are alternately arranged. In a second pixel column, the green pixels G11 and G31 and the red pixels R21 and R41 are alternately arranged. In a third pixel column, the blue pixels B11 and B31 and the green pixels G21 and G41 are alternately arranged.

In other words, in two adjacent pixel columns, one of the red, green and blue pixels are arranged in a zigzag shape, and the other two of the red, green and blue pixels are alternately arranged in another zigzag shape.

In the LCD device, adjacent pixels share the gate line, and adjacent pixels share the data line. As a result, an area for the TFT is reduced in comparison to the related art LCD device such that the aperture ratio and the transmittance in the pixel are improved.

In more detail, the TFTs Tr (of FIG. 3) of a $(2a-1)$th pixel and a $(2a)$th pixel in a $(2b)$th pixel column share a $(2a)$th gate line, and the TFTs Tr (of FIG. 3) in a $(2a)$th pixel and a $(2a+1)$th pixel in a $(2b+1)$th pixel column share a $(2b+1)$th gate line. (Each of "a" and "b" is a positive integer.) In FIG. 5, the TFT Tr of the green pixel G11, e.g., the first pixel in the second pixel column, and the TFT Tr of the red pixel R21, e.g., the second pixel in the second pixel column, share the second gate line GL2. In addition, the TFT Tr of the green pixel G21, e.g., the second pixel in the third pixel column, and the TFT Tr of the blue pixel B31, e.g., the third pixel in the third pixel column, share the third gate line GL3.

On the other hand, the thin film transistors Tr of a $(2c-1)$th pixel and a $(2c)$th pixel in a $(2d-1)$th pixel row share a $(2c)$th data line, and the thin film transistors of a $(2c)$th pixel and a $(2c+1)$th pixel in a $(2d)$th pixel row share a $(2c+1)$th data line. (Each of "c" and "d" is a positive integer.) In FIG. 5, the TFT Tr of the red pixel R11, e.g., the first pixel in the first pixel row, and the TFT Tr of the green pixel G11, e.g., the second pixel in the first pixel row, share the second data line DL2. In addition, the TFT Tr of the red pixel R21, e.g., the second pixel in the second pixel row, and the TFT Tr of the green pixel GB21, e.g., the third pixel in the second pixel row, share the third data line DL3.

For example, the TFT Tr of the red pixel R11 in the first pixel column and the first pixel row is electrically connected to the first gate line GL1 and the second data line DL2, and the TFT Tr of the red pixel R21 in the second pixel column and the second pixel row is electrically connected to the second gate line GL2 and the third data line DL3. The TFT Tr of the green pixel G11 in the second pixel column and the first pixel row is electrically connected to the second gate line GL2 and the second data line DL2, and the TFT Tr of the green pixel G21 in the third pixel column and the second pixel row is electrically connected to the third gate line GL3 and the third data line DL3. The TFT Tr of the blue pixel B11 in the third pixel column and the first pixel row is electrically connected to the first gate line GL1 and the fourth data line DL4, and the TFT Tr of the blue pixel B21 in the first pixel column and the second pixel row is electrically connected to the third gate line GL3 and the first data line DL1.

In the LCD device including the above pixel arrangement, the number of the data lines, where the high-gray data signal is applied, is constant such that the increase of the power consumption is not generated.

For example, when the gate signal is applied to the second gate line GL2, the high-gray data signal is applied into three data lines, i.e., the third, fourth and ninth data lines DL3, DL4 and DL9, to drive three red pixels R21, R12 and R23. In this instance, the low-gray data signal is applied into other data lines, i.e., the first, second, fifth to eighth and tenth data lines DL1, DL2, DL5 to DL8 and DL10. On the other hand, when the gate signal is applied to the third gate line GL3, the high-gray data signal is applied into three data lines, i.e., the second, fifth and eighth data lines DL2, DL5, DL8, to drive three red pixels R31, R22, R33. In this instance, the low-gray data signal is applied into other data lines, i.e., the first, third, fourth, sixth, seventh, ninth and tenth data lines DL1, DL3, DL4, DL6, DL7, DL9 and DL10.

An exemplary driving method of the LCD device including the pixel arrangement in a pixel group PG of FIG. 5 is explained.

Four gate lines GL1 to GL4 and seven data lines DL1 to DL7 are formed to define 18 pixels in a 3*6 matrix. The 18 pixels in the 3*6 matrix form the pixel group PG.

In the pixel group PG, when the gate signal is applied to the second gate line GL2 in the pixel group PG, the high-gray data signal should be applied into the third and fourth data lines DL3 and DL4 to drive two red pixels R21 and R12. In this instance the low-gray data signal is applied into the first, second and fifth to seventh data lines DL1, DL2 and DL5 to DL7. In addition, when the gate signal is applied to the third gate line GL3 in the pixel group PG, the high-gray data signal should be applied into the second and fifth data lines DL2 and DL5 to drive two red pixels R31 and R22. In this instance, the low-gray data signal is applied into the first, third, fourth, sixth and seventh data lines DL1, DL3, DL4, DL6 and DL7.

As explained above, the high-gray data signal is applied to two data lines both when the second gate line GL2 is selected and when the third gate line GL3 is selected. Namely, in the LCD device in FIG. 5, the number of the data lines, where the high-gray data signal is applied, is not changed.

Accordingly, the power consumption for an amplifier (not shown) amplifying the output signal of the data driving circuit (not shown) is not increased.

As a result, the LCD device has advantages in the aperture ratio and the transmittance without increase of the power consumption.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display device, comprising:

gate lines extending on a substrate;

data lines crossing the gate lines to define a plurality of pixels;

a thin film transistor in each pixel; and a liquid crystal capacitor in each pixel region, an electrode of the liquid crystal capacitor is connected to the thin film transistor, wherein the thin film transistors of a (2*a*−1)th pixel and a (2*a*)th pixel in a (2*b*)th pixel column share a (2*a*)th gate line, and the thin film transistors in a (2*a*)th pixel and a (2*a*+1)th pixel in a (2*b*+1)th pixel column share a (2*b*+1)th gate line, and wherein each of a and b is a positive integer, wherein the plurality of pixels include first to sixth pixels in a first pixel row and seventh to twelfth pixels in a second pixel row defined by first to third gate lines and first to seventh data lines, wherein the first to sixth pixels correspond to red, green, blue, red, green and blue color filters, respectively, and the seventh to twelfth pixels correspond to blue, red, green, blue, red and green color filters, respectively, and wherein when the gate signal is applied to the second gate line, among the twelve pixels, only some of four pixels corresponding to a single color are applied with a high-gray data signal at corresponding data lines and a low-gray data signal is applied to remaining data lines other than the corresponding data lines to display a single colored image.

2. The device according to claim 1, wherein the thin film transistors of a (2*c*−1)th pixel and a (2*c*)th pixel in a (2*d*−1)th pixel row share a (2*c*)th data line, and the thin film transistors of a (2*c*)th pixel and a (2*c*+1)th pixel in a (2*d*)th pixel row share a (2*c*+1)th data line, wherein each of c and d is a positive integer.

3. The device according to claim 2, further comprising first to third color filters corresponding to each pixel, wherein the first to third color filters are arranged in a stripe shape.

4. The device according to claim 2, further comprising first to third color filters corresponding to each pixel, wherein one of the first to third color filters are arranged in a zigzag shape in two adjacent pixel columns, and the first to third color filters are alternately arranged in each pixel row.

5. The device according to claim 2, further comprising first to third color filters corresponding to each pixel, wherein in a 2*2 matrix shaped pixel arrangement, one of the first to third color filters is positioned at two pixels in a diagonal line, and the other two of the first to third color filters are positioned at the other two pixels.

6. A method of driving a liquid crystal display device, which includes first to fourth gate lines, first to seventh data lines crossing the first to fourth gate lines to define 18 pixels arranged in a 3*6 matrix; a thin film transistor in each pixel; first to third color filters corresponding to each pixel; and a liquid crystal capacitor in each pixel region, an electrode of the liquid crystal capacitor is connected to the thin film transistor, wherein the thin film transistors of a (2*a*−1)th pixel and a (2*a*)th pixel in a (2*b*)th pixel column share a (2*a*)th gate line, and the thin film transistors in a (2*a*)th pixel and a (2*a*+1)th pixel in a (2*b*+1)th pixel column share a (2*b*+1)th gate line, wherein the thin film transistors of a (2*c*−1)th pixel and a (2*c*)th pixel in a (2*d*−1)th pixel row share a (2*c*)th data line, and the thin film transistors of a (2*c*)th pixel and a (2*c*+1)th pixel in a (2*d*)th pixel row share a (2*c*+1)th data line, wherein one of the first to third color filters are arranged in a zigzag shape in two adjacent pixel columns, and the first to third color filters are alternately arranged in each pixel row, and wherein each of a, b, c and d is a positive integer, the method comprising:

applying a first gate signal into the second gate line;

applying a high-gray data signal into the third and fourth data lines and a low-gray data signal into the first, second and fifth to seventh data lines;

applying a second gate signal into the third gate line; and applying a high-gray data signal into the second and fifth data lines and the low-gray data signal into the first, third, fourth, sixth and seventh data lines, wherein the 18 pixels include first to sixth pixels in a first pixel row and seventh to twelfth pixels in a second pixel row defined by first to third gate lines and first to seventh data lines, wherein the first to sixth pixels correspond to red, green, blue, red, green and blue color filters, respectively, and the seventh to twelfth pixels correspond to blue, red, green, blue, red and green color filters, respectively, and wherein when the first gate signal is applied to the second gate line, among the 18 pixels, only some of six pixels corresponding to a red color are applied with a high-gray data signal at corresponding data lines and the low-gray data signal is applied to remaining data lines other than the corresponding data lines to display a red colored image.

7. The display device according to claim 1, wherein the plurality of pixels further includes thirteenth to eighteenth pixels in a third pixel row defined further by a fourth gate line, wherein when a first gate signal is applied to the second gate line, the high-gray data signal is applied to the third and fourth data lines and the low-gray data signal is applied to the first, second, fifth, sixth and seventh data lines, and wherein when a second gate signal is applied to the third gate line, the high-gray data signal is applied to the second and fifth data lines and the low-gray data signal is applied to the first, third, fourth, sixth and seventh data lines to display a red colored image.

8. The device according to claim 1, wherein when the gate signal is applied to the second gate line, among the twelve pixels, only two of four pixels corresponding to the single colored image receive the high-gray data signal and the low-gray data signal is applied to other five of the first to seventh data lines to display a single colored image, and wherein a number of data lines where the high-gray data signal is applied is constant when displaying different single colored images.

9. The device according to claim 1, wherein when the gate signal is applied to the second gate line, the high-gray data signal is applied to the two of the first to seventh data lines and the low-gray data signal is applied to the other five of the first to seventh data lines to display a single colored image for an entire frame period.

* * * * *